United States Patent [19]

Eberhardt et al.

[11] Patent Number: 4,995,729

[45] Date of Patent: Feb. 26, 1991

[54] MIXING DEVICE FOR MORTAR

[75] Inventors: Kurt Eberhardt, Bad Hersfeld; Reinhold Nibrig, Heringen, both of Fed. Rep. of Germany

[73] Assignee: Babcock-BSH Aktiengesellschaft, vormals Büttner-Schilde-Haas AG, Krefeld, Fed. Rep. of Germany

[21] Appl. No.: 235,343

[22] Filed: Aug. 23, 1988

[30] Foreign Application Priority Data

Sep. 2, 1987 [DE] Fed. Rep. of Germany ..... 8711865
Sep. 2, 1987 [DE] Fed. Rep. of Germany ..... 3729233

[51] Int. Cl.[5] ..... B01C 7/22

[52] U.S. Cl. ..... 366/2; 366/65; 366/177; 366/167; 366/316

[58] Field of Search ..... 366/65, 64, 98, 168, 366/167, 173, 177, 262, 263, 316, 309, 295, 314, 315, 317, 2; 277/71, 72, 13, 14 V, 57, 135

[56] References Cited

U.S. PATENT DOCUMENTS

| | | | |
|---|---|---|---|
| 2,425,689 | 8/1947 | Schwarz | 366/317 X |
| 2,573,425 | 10/1951 | Fletcher, Jr. | 277/72 |
| 2,903,970 | 9/1951 | Elovitz et al. | 277/14 X |
| 3,018,091 | 1/1962 | Duggins | 360/194 X |
| 3,081,069 | 3/1963 | Oakes | 366/317 X |
| 3,131,641 | 5/1964 | Cygnor | 277/13 X |
| 3,529,936 | 9/1970 | Muller-Rid et al. | 366/317 X |
| 3,756,570 | 9/1973 | Buhner | 366/295 X |
| 3,774,887 | 11/1973 | Dunn | 366/98 X |
| 4,176,972 | 12/1979 | Stiling | 366/317 X |
| 4,196,910 | 4/1980 | Aizu | 277/72 R XR |
| 4,397,795 | 8/1983 | Jackson | 277/14 V XR |

FOREIGN PATENT DOCUMENTS

| | | | |
|---|---|---|---|
| 467967 | 2/1971 | Japan | 277/57 |

*Primary Examiner*—Frankie L. Stinson
*Attorney, Agent, or Firm*—Herbert Dubno

[57] ABSTRACT

A mixer for mortar has part of its water feed introduced between a rotating disk and the floor of the disk housing, this water being propelled outward through an annular constriction in the clearance between the disk and the housing so that the rotor is kept constantly pressured by the inflowing water. The rest of the water is introduced through inlets spaced in a ringlike arrangement in the housing cover so as to produce a continuous water film on the rotating disk, onto which the powdered plaster and any other additives are fed.

9 Claims, 2 Drawing Sheets

MIXING DEVICE FOR MORTAR

FIELD OF THE INVENTION

Our present invention relates to a mixing device, in particular for the preparation of mortar from a finely-divided binder, and especially from gypsum or plaster.

BACKGROUND OF THE INVENTION

For the continuous production of plaster sheets, especially plasterboard, gypsum (calcium sulfate hemihydrate) is admixed with water in a plaster mixing device to form a plaster paste (mortar), which is deposited onto a continuous moving endless belt and there allowed to setup (harden). Finally, the set plaster (calcium sulfate dihydrate) is cut into sheets.

Plaster mixing devices are described in U.S. Pat. Nos. 1,758,200 and 2,253,059 wherein a rotating disk or both the rotating disk and the underside of the housing cover have rows of pins arranged radially or spirally, where the rows of pins on the rotating disk and the housing cover penetrate into one another.

Water, gypsum (plaster of Paris) powder, and additives are fed from above onto such a rotating disk. By means of centrifugal force, the solid and liquid materials are propelled outward between the pins. They are thereby mixed, and in some cases further mixed by an arrangement of coarse teeth on the rotating disk. The plaster paste flows past the edge and down through any teeth which may be present, then through one or more outlets to the conveyer belt.

A disadvantage of such mixers is that as new material is continually added, plaster paste intrudes under the rotating disk into the clearance space between the disk and the housing floor and then sets up. The hardened deposits of gypsum dihydrate which are thus formed can jam or bind the rotating disk. They become broken down and cause abrasion. The broken down dihydrate fragments are carried along with the plaster paste to the outlet of the mixer and onto the conveyer belt.

A further disadvantage of such mixers is that the rows of pins create stagnant zones, in which the plaster paste can be trapped and then sets up. In this way, dihydrate deposits form, which break off and get broken down further to small particles which also get delivered to the conveyer belt along with the plaster paste.

The dihydrate particles in the plaster paste tend to form stable clusters of unbindable dihydrate resulting in local acceleration of the setting of the plaster in these regions. This leads to irregularly distributed soft and hard places in the finished plasterboard. Since the rate of production is predicated on a constant setting rate, uneven acceleration also causes production disturbances.

A further disadvantage of these pin mixers is that certain grades of plasterboard can generally not be made, or can be made only with difficulty, because the interpenetrating pins hinder the admixture of foam, chips, long glass fibers, or other fibrous materials to the mortar.

Foam which is added is broken down by the interpenetrating pins, forming large bubbles and resulting in inhomogeneous texture, therefore to density variations in the finished sheets.

Chips which are added become lodged between the pins. Long fibers wrap around the pins and form skeins. Both effects disturb the operation of the machine, influence the quality of the plaster mix, and lead to heavy maintenance requirements.

Even without addition of chips or fibers, the pins are subject to constant abrasion, so that they often have to be replaced.

An even more fundamental disadvantage of the pin mixer is that dihydrate particles and in some cases, chips and fibers, get above and beneath the rotating disk, and cause a major requirement for repair and maintenance by obstructing the mixer, by blocking or jamming the rotating disk, and by abrasive action.

German Patent Application No. 29 31 782 describes a category of mixers wherein the pins are replaced by interpenetrating deflecting blades and circulating pump elements with resultant improvement in mixer efficiency. Also, a scraper is provided on the underside of the rotating disk, which extends into the small clearance space and serves to remove any intruding plaster paste.

The scraper still has the disadvantage that it abrades so that the distance between the rotating disk and the floor of the housing must be periodically readjusted. Precise readjustment is impossible, because it is impossible to see into the clearance space.

Besides the maintenance by means of readjustment, it is characteristic of such a scraper that because of the difficulty of readjustment, it is not possible to completely prevent the plaster paste from intruding under the rotating disk and forming dihydrate particles in that region.

Although the deflecting blades and the circulating pump elements are designed and arranged so that the stagnant flow regions are reduced as compared to the pin mixer, nevertheless it is impossible to completely forestall the formation of dihydrate particles which get into the plaster paste and which strongly affect the quality and production of the sheets.

These interpenetrating deflecting blades and circulating pump elements also break down any foam which may be added and they form barriers for chips and long fibers. Thus with these mixers also, there are certain grades of plasterboard which either cannot be made or can be made only with difficulty.

Similarly with these mixers there is a high maintenance requirement because of the wear on the deflecting blades and on the circulating pump elements.

In a further pin mixer, described in German Patent Application No. 36 11 048, coarse admixed materials which occur in plaster paste and which intrude into the crevice between the underside of the rotating disk and the floor of the housing, no longer can jam the rotating disk. In this type of plaster mixer, at the forward edge of teeth attached to the rotating disk, there is a cutting edge which rides close to the floor of the housing, with a space behind the cutting edge. Granular or fibrous additives which intrude are repelled radially outward by the wiping edges of wiping strips located on the underside of the rotating disk. This process is enhanced by the jet action of a water and an air stream conducted through the housing body.

Even in this mixer, gypsum pastes containing coarse additives succeed in intruding under the rotating disk. Therefore, the protective laminate and the stripping bars become worn and have to be replaced. It is also disadvantageous that because of the blower-like action of the stripping bars, air is pressured into the plaster paste.

The formation as well as the discharge of dihydrate particles onto the conveyer belt with adverse effects on the quality and production of the plasterboard are not prevented; the plaster paste below and especially above the rotating disk, which is provided with stirring blades, can set up to dihydrate. The production of those grades of plasterboard which require foam, chips or fibers is made more difficult.

OBJECT OF THE INVENTION

It is an object of the present invention to provide a mixer especially of the type having a rotating disk in a housing, which allows the continuous production of well mixed mortar, especially of gypsum plaster paste, in a diversity of grades, with small maintenance requirements, with high efficiency and with freedom from production disturbances.

SUMMARY OF THE INVENTION

These objects and other which will become apparent hereinafter are attained in accordance with the present invention in a mixer having a cylindrical housing in which there is situated a rotating disk, this disk being rotatable about the vertical axis of the housing.

Teeth are provided around the periphery of this rotating disk.

The top cover of the housing has at least one inlet for solid material and at least one inlet for water.

There is at least one outlet for plaster paste in the floor of the housing near the periphery of this housing, each of such outlets being located below the teeth.

There is also at least one water inlet in the floor of the housing within the region defined by the teeth.

A critical feature of the present invention is that there is an annular constriction of the clearance space between the disk and the floor of the housing, this constriction being between the water inlet in the floor of the housing and the teeth. By virtue of this annular constriction of the clearance space, the resistance to the flow of water from beneath is increased so that there is a uniform outward water flow between the housing floor and the rotating disk. This uniform water flow leads to a fully "floating" suspension of the rotating disk, that is, the underside of the disk is constantly under substantial pressure of flowing water, which completely hinders the intrusion of plaster paste into the clearance space.

The need for repositioning the scraper and for replacing worn parts is dispensed with; also avoided is the need for cleaning or repairing of the jammed rotating disk. The mixer of the invention has a substantially increased on-line (operating) time. The need for maintenance is substantially reduced.

It is also especially advantageous that very few dihydrate particles reach the effluent plaster paste, so that the quality of the plaster sheets thus produced is improved.

The aforementioned constriction can be merely an annular region of closer proximity of disk to housing floor, as achieved by annular thickening of one or another or both at the same radius; however, in an advantageous feature of the invention, the constriction is labyrinthine.

By "labyrinthine" we here mean that the clearance space is not only constricted but has turns in the radial pathway from the axial region to the exterior, so as to force the water flowing through this space to take a tortuous path.

An advantage of the labyrinthine constriction is that it is easy to build such a constriction with small clearances, so that in a simple manner a sufficiently high resistance to flow is achieved.

One embodiment of a labryrinthine constriction has a profile (viewed along a radius in the plane of the disk) of an open rectangle, which is achieved simply by having a ring of rectangular profile protruding downward from the disk and penetrating a slightly larger slot of rectangular profile in the housing floor; other labyrinthine configurations with several rings and slots or other tortuous profiles in the clearance space will be readily apparent to one skilled in the art of machine design.

Another advantagous feature of the invention provide water inlets arranged at substantially equal angles around the axis, and where the rotating disk has a thickened portion in the vicinity of the axis, and where this thickened portion is connected to the outer annular unthickened portion of the disk by a curved surface, the curved surface being located under the water inlets so that the incoming water impinges on the curved surface. In this way, the water is distributed evenly onto the rotating disk to form a smooth unbroken film onto which the plaster powder falls, and by this means, the mixing effect is improved.

This feature of the invention is also highly advantageous for achieving uniformity of the plaster sheets, since by virtue of the smooth surface of the rotating disk and of the housing cover, there are no stagnant flow regions and thus dihydrate particles are not formed either on or below the rotating disk.

The mixer of the invention also enables diverse grades of prefabricated plaster sheets to be made, with admixture of foam, chips, and long fibers; the use of foam reduces the specific gravity and improves the thermal insulating capability, and the use of chips or fibers improve the stiffness. Problems caused by chips or fibers getting caught between pins are completely avoided in the mixer of the invention, thus further reducing maintenance requirements.

In a further advantageous feature of the invention, the rotating disk is made of corrosion resistant steel, or the rotating disk is provided with a protective laminate of corrosion resistant steel. Such means avoid the formation of rust on the disk, which if allowed to form could cause clinging and setting up of the plaster paste.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
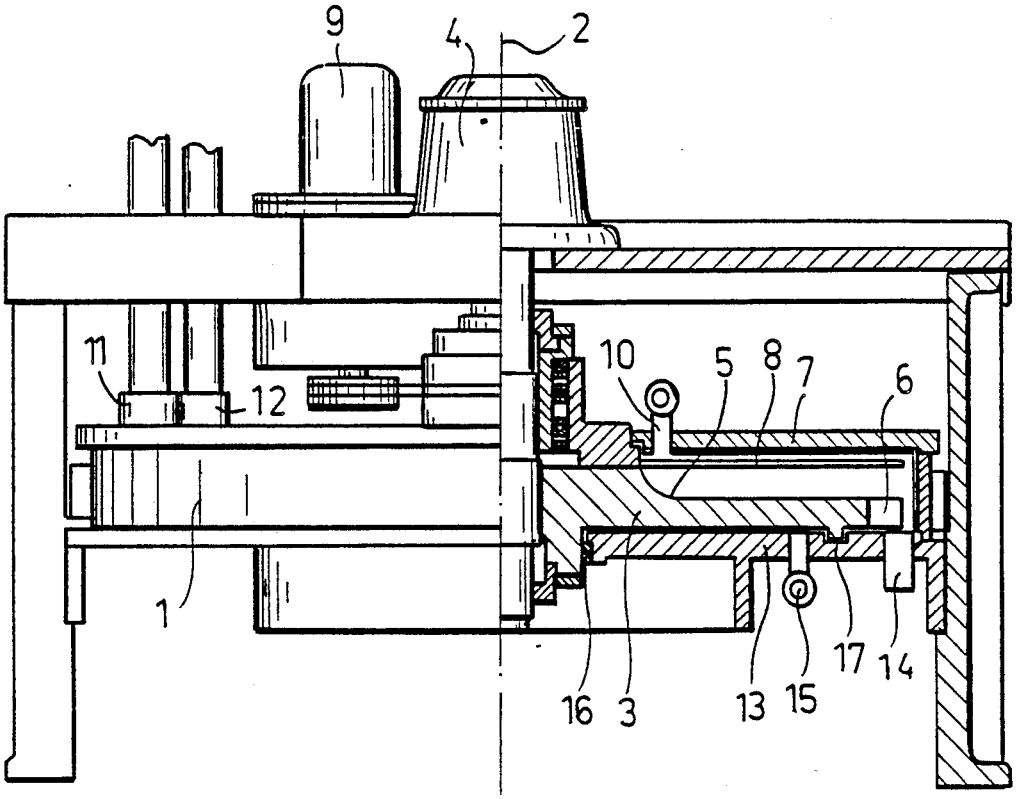
FIG. 1 is a view of a plaster mixing device shown partly as a lengthwise section.
Figure 2:
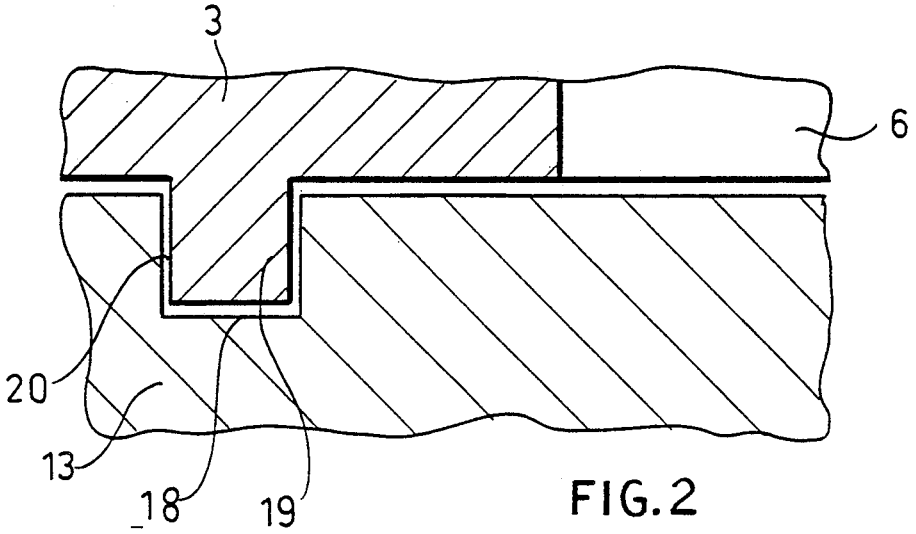
FIG. 2 is an enlarged view of the labyrinthine constricted region.

The plaster mixing device, in a suitable support mounting, consists essentially of a flat cylindrical housing 1, in which is installed a rotating disk, rotatable about the perpendicular axis 2 of the housing. A motor 4 for driving the rotating disk 3 is installed above the housing.

The rotating disk 3 is made of rust-resistant steel (stainless steel) or is provided with a wear-plate of rust-resistant material (stainless steel). The disk 3 has on its upper side in the region of the axis 2 a thickened region, the diameter of which amounts to about one-third of the disk diameter. The transitional region between the thickened area and the flat outer annular zone has the form of a concave rounded region 5; in other words, the transitional region has the form of a bevel whose face is curved downward. In the region of the annular zone, the rotating disk 3 is smooth on the upper side and completely free of projections.

Figure 3:
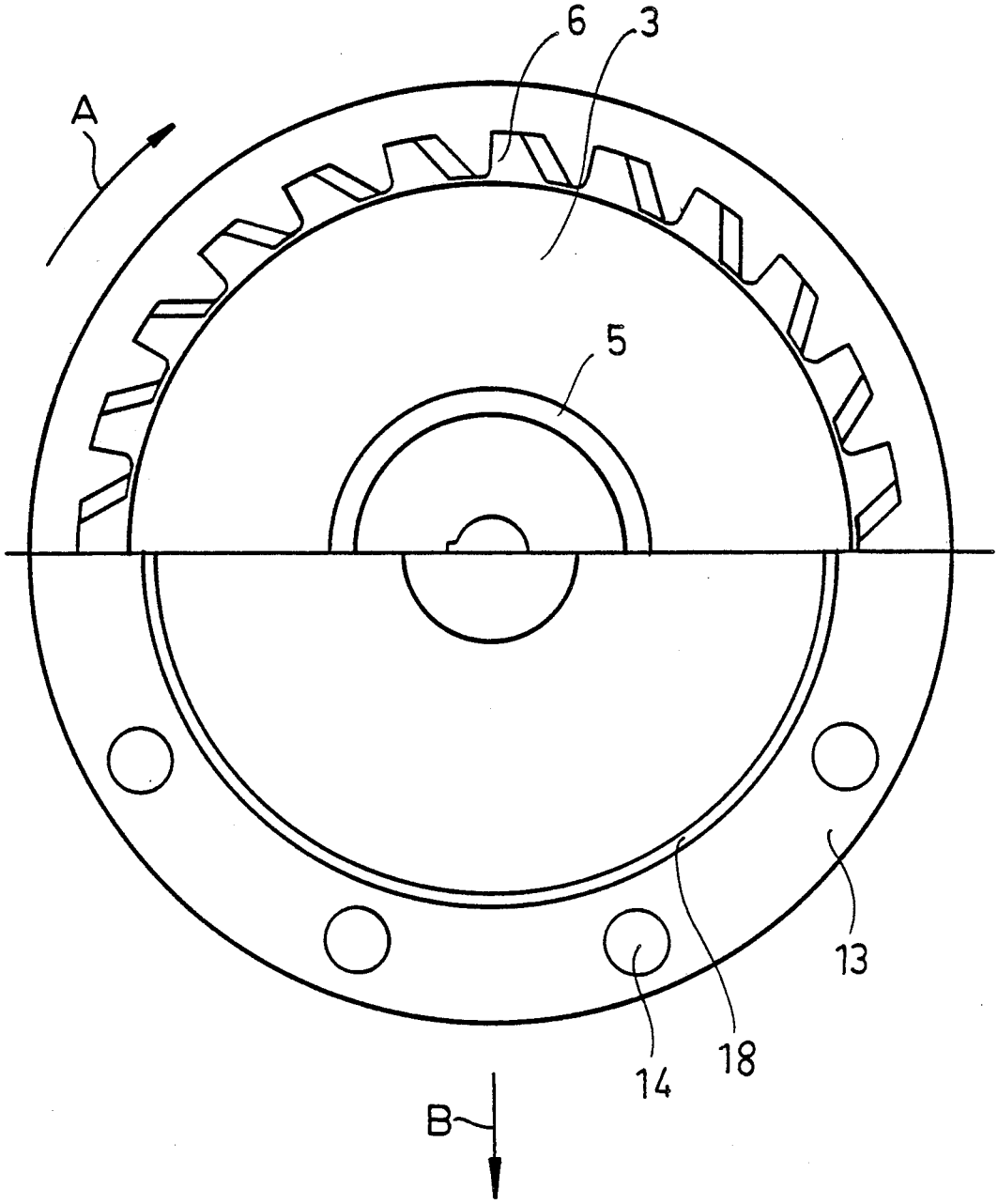
FIG. 3 is a view of the floor of the housing as well as of the rotating toothed disk. Arrow A indicates the turning direction of the rotating disk and arrow B indicates the direction of motion of the conveyer.

On its edge, the rotating disk 3 is provided with coarse teeth 6. The sides of the teeth in the direction of rotation (that is to say, the right sides when turning in a clockwise direction in FIG. 3) form an acute angle with respect to the direction of motion. The extremities of the teeth reach almost to the cylindrical housing wall.

Above the rotating disk 3 and below the housing cover 7, there are centrally positioned bar-shaped scraping blades 8, extending close to the housing wall, these being rotatable about the housing axis 2 by a separate drive means 9.

In the housing cover 7, close to the axis and above the rounded region 5, there are twelve water inlets 10 each provided with feeding means and located at equiangular positions around the housing axis 2. At a somewhat greater distance from the axis 2 there is located in the housing cover an inlet 11 for the plaster powder and, in some cases (not shown in the drawing), inlets for additives (fibers, chips), also a foam inlet 12 and an air vent not shown in the drawing.

The housing cover 7, similarly to the upper side of the rotating disk, has its underside completely free of pins and any other projecting parts.

In the housing floor 13, there are in the periphery below the teeth 6, arranged on a semicircle, four outlets 14 for the plaster mix. In the housing floor 13 there is a water inlet 15, provided with means for feeding water maintained at a pressure of 3 atmospheres. The distance of this water inlet 15 from the axis 2 is smaller than the radius of the region defined by the teeth 6 of the rotating disk 3.

The small clearance space between the housing floor 13 and the rotating disk 3 is sealed off in the direction towards the axis 2 by an annular seal 16 and has towards its edge a labyrinthine constriction 17 which surrounds the region in which the water inlet 15 is confined. The housing floor 13 is free of any openings other than the four outlets 14 and the opening for the water inlet 15.

The constriction 17 is formed by an annular groove 18 in the floor 13 of the housing and by a ring 19 located on the underside of the rotating disk 3 and which penetrates into the annular groove 18. The penetrating ring 19 is located at the edge of the rotating disk 3 and interior with respect to the teeth 6. The narrowest places in the constriction 17 are the lateral clearances 20 between the annular groove 18 and the ring 19.

In operation, solid and liquid materials, and in some cases, aqueous foam, are added from above onto the rotating disk 3. The equally divided water inlets 10 and the rounded area 5 bring about an uninterrupted smooth film of water onto which the gypsum powder falls, thus resulting in the initial mixing of the added materials. The material is propelled in an outward direction by centrifugal force and is mixed even more uniformly by passage through the angular-edged teeth 6 and through the scrapers 8 which are turning at a somewhat slower rate of rotation than the rotating disk 3 (turning velocity of the disk 3 is for example 291 rpm and turning velocity of the scraper 8 is for example 264 rpm). The plaster paste thus produced flows down from the teeth 6 through the outlet 14 onto the conveyer belt.

Seven percent of the required water for the mix is added from below through the adjustible inlet 15. This water flows outwardly and by means of the labyrinthine constriction 17 it is distributed evenly over the circumference. Beyond the constriction 17 it is admixed with the plaster paste. The labyrinthine constriction 17 increases the resistance to flow of the water in such as way that the rotating disk is maintained in a "floating" manner, that is, constantly pressured by the water flowing from beneath. The water streaming up from below completely prevents the plaster paste from intruding under the rotating disk 3.

The consumption of current is distinctly lower with the mixing equipment of the invention than with the prior art mixing equipment, especially in the processing of fiber-containing material. The paste is essentially completely free of air bubbles. The consistency of the paste is the same at all four outlets 14. The maintenance interval can be extended severalfold; the only parts which undergo substantial wear are the scrapers.

The mixer of the invention is also suitable for other like applications such as continuous production of lime mortar for plastering of large surfaces, also for production of plastic mortar and mortars based on cement or lime for prefabricated part manufacture.

The invention also encompasses the method of making a uniform plaster paste by admixing water and plaster powder, using ratios well known to those skilled in the art, in the device of the invention described hereinabove. In particular, the invention affords a method, not heretofore satisfactorily available, for mixing foams, chips, and/or fibers into plaster paste in a continuous trouble-free manner, these additional ingredients being added onto the smooth film of water on the rotating disk through openings in the top of the housing intended for such additional ingredients.

We claim:

1. A mixer comprising:

a cylindrical housing having a vertical housing axis;

a rotating disk in said housing, rotatable about said axis;

teeth around the periphery of said disk;

at least one water inlet in the top cover of said housing;

at least one inlet for solid material in the top cover of said housing;

at least one outlet for the mixed material in the floor of said housing and near the periphery of said housing, said outlet being located below said teeth;

at least one water inlet in the floor of said housing and within the region defined by said teeth; and an annular constriction of the clearance between said disk and the floor of said housing, said constriction being between said water inlet in the floor of said housing and said teeth, said water inlet in the floor of the housing and said constriction providing means for keeping the underside of said disk under constant pressure of flowing water.

2. A mixer defined by claim 1 wherein the constriction is labyrinthine.

3. A mixer defined by claim 1 wherein a multiplicity of said water inlets are arranged at substantially equal angles around said axis, and where said rotating disk has in a vicinity of said axis a thickened portion, and where said thickened portion is connected to the outer annular unthickened portion of said disk by a curved surface, said curved surface being located under said water inlets so as to serve for uniform distribution of water onto said disk.

4. A mixer defined in claim 1 where said housing has in its cover at least one opening for additional additives.

5. A mixer defined in claim 1 where said rotating disk is comprised of stainless steel.

6. A mixer defined in claim 1 where coaxial scraping blades are provided, said scraping blades rotating at a lower rotational velocity than the rotational velocity of said rotating disk.

7. A method of mixing plaster paste which comprises introducing water and plaster powder into a mixer as defined in claim 1.

8. A method as defined in claim 7 wherein at least one additional component is admixed, selected from the group consisting of foam, chips, and fibers.

9. A mixer comprising:

a cylindrical housing having a vertical housing axis and a top cover;

a rotating disk in said housing, rotatable about said axis;

teeth around a periphery of said disk;

at least one water inlet in said top cover of said housing;

at least one inlet for solid material in said top cover of said housing;

at least one outlet for mixed material in a floor of said housing and near said periphery of said housing, said outlet being located below said teeth;

at least one water inlet in a floor of said housing and within a region defined by said teeth; and an annular constriction of a clearance between said disk and said floor of said housing, said constriction being formed by an annular groove in said floor and by a ring located on an underside of said rotating disk, said ring penetrating into said annular groove, said constriction being between said water inlet in said floor of said housing and said teeth, said water inlet in said floor of said housing and said constriction providing means for keeping an underside of said disk under constant pressure of flowing water.

* * * * *